US005791089A

United States Patent [19]

Prevot et al.

[11] Patent Number: 5,791,089

[45] Date of Patent: Aug. 11, 1998

[54] ROLLING DEVICE FOR A SLIDING LEAF OF A DOOR WINDOW OR THE LIKE

[75] Inventors: Gérard Prevot, Willerwald; Sylvain Klespert, Sarrebourg, both of France

[73] Assignee: Ferco International, Sarrebourg, France

[21] Appl. No.: 834,956

[22] Filed: Apr. 7, 1997

[30] Foreign Application Priority Data

Apr. 10, 1996 [FR] France ..... 96 04637

[51] Int. Cl.[6] ..... F05D 13/00

[52] U.S. Cl. ..... 49/425

[58] Field of Search ..... 49/404, 414, 425, 49/420, 426, 427

[56] References Cited

U.S. PATENT DOCUMENTS

| | | | |
|---|---|---|---|
| 4,262,451 | 4/1981 | Dallaire | 49/425 |
| 4,282,631 | 8/1981 | Uehara et al. | 49/425 X |
| 4,404,771 | 9/1983 | Murase et al. | 49/425 |
| 4,899,493 | 2/1990 | Baumgarten | 49/425 |

*Primary Examiner*—Jerry Redman
*Attorney, Agent, or Firm*—Harrison & Egbert

[57] ABSTRACT

A rolling device for a sliding leaf (2) of a door or window and having a slide (7) aimed at being accomodated in the slit (24) provided for in the lower edge (23) of a profile (4) defining the lower rail (3) of the leaf (2), this slide (7) resting against a metallic reinforcement (6) or a horizontal wall (44) located in the inner portion (5) of the profile (4). The slide (2) is also provided a hooking-in member (27, 28), cooperating with the transversal edges (29, 30) of the slit (24), defined by a horizontal rim (31) at the level of its transversal ends (17, 17A), at least one horizontal rim (31) being subjected to springy restoring member (33) allowing to withdraw the hooking-in member (27) in order to allow the passing through, by snapping in, of this latter, and its removal, the hooking-in member (27, 28) being completed by a retaining member (47) capable of vertically immobilizing the rolling device (1) in the slit (24) of the profile (4).

8 Claims, 1 Drawing Sheet

ROLLING DEVICE FOR A SLIDING LEAF OF A DOOR WINDOW OR THE LIKE

BACKGROUND OF THE INVENTION (1). Field of the Invention

The invention relates to a rolling device for a sliding leaf of a door, window or the like, comprising a slide receiving rolling means and aimed at being accomodated in a slit provided for in the lower edge of a profile defining the lower rail of said leaf which the slide is made integral with through fixing means comprised, at each transversal end of the slide, of hooking-in means capable of hooking in on the transversal edges of the slit in order to impede the disengagement of said slide, this latter being capable of resting against a metallic reinforcement or a horizontal wall located in the inner portion of said profile.

This invention will find its application in the field of the ironmongery for buildings and furniture.

(2). Description of the Prior Art

There are already known a number of rolling devices corresponding to the description which is made above of same and facilitating the movement of a sliding leaf corresponding e.g. to a door, window or the like.

Thus, these rolling devices are in the shape of a slide inserted under the lower rail of said leaf through appropriate fixing members. In this respect, the rolling device according to the invention is in particular aimed at being fitted on leaves formed by an assembling of tubular profiles made of metal, e.g. aluminium, or of synthetic material, such as PVC. There should be observed that such a tubular profile made of aluminium or PVC, defining the lower rail of a leaf, includes a U-shaped groove located at the level of its lower edge, into which is actually positioned the slide corresponding to the rolling device.

As a matter of fact, this groove often has an insufficient depth, so that it is necessary to make a slit allowing to at least partially insert the slide into same.

Under such circumstances arises the problem of fixing this latter on the profile. As a matter of fact, according to a first known embodiment, the slide is provided, at each of its ends and in the longitudinal direction, with fastening lugs serving for the passing through of fixing organs, such as screws, rivets or the like, which are screwed or inserted into holes provided for on both sides of the slit present in the bottom of the U-shaped groove of the tubular profile.

Under such circumstances it is necessary for the length of the slit made for receiving the slide to accurately fit this latter, for otherwise the openings for the passing through of the fixing organs either fall in the slit or are located too close to this latter, so that the material is weakened at that spot and is not strong enough to receive the fixing organs.

In addition, it should be noticed that though the previously evoked solution is constraining, but can be contemplated in the case of leaves made of metal profiles, e.g. made of aluminium, it cannot be used at all when the tubular profile forming the lower rail of this leaf is made of synthetic material, in particular of PVC.

As a matter of fact, under such circumstances, the tubular profile includes, in its inner portion, a reinforcement in the shape of a metal profile against which rests the slide of a rolling device.

Therefore, the reinforcement is machined so as to allow same to receive the fixing organs, such as screws, rivets or the like, which, furthermore, pass through the openings provided for in the fastening lugs of the slide. Here too, one will admit that this machining of the reinforcements is particularly constraining, requiring the use of a template, etc . . . , without forgetting that, in this case, it is often absolutely necessary to make a deeper slit in the profile made of PVC, in order to enable, as the case may be, the machining of the reinforcement or the passing through of the fastening lugs associated with the slide.

Finally, there should be observed that though there is referred to riveting for ensuring the connection between the profile and the rolling device, screws are more often used, in order to allow the removal. Well now, screwing is considered by the carpenters as a time-taking and therefore expensive operation. In addition, the dismantling is not less constraining, since it necessary to have access with a screwdriver under the lower rail of this leaf to remove the fixing organs. One easily understands that this cannot be done by simply slightly lifting this leaf. As a matter of fact, it is almost necessary to place the leaf horizontally to proceed to the operation.

U.S. Pat. No. 4,850,078 teaches a rolling device installed in the lower rail corresponding to a sliding leaf and formed by a substantially tubularly shaped profile.

In particular, this device is inserted inside a slit made in the lower wall of the profile and defining the lower edge of the leaf. One should observe that the slit has transversal edges which fixing means for the device are capable of co-operating with.

In this respect, the fixing means include hooking-in means which are, in particular, in the shape of substantially vertical springy blades integrated into the transversal walls of the device, one free end of which rests on the inner wall of the transversal edges of the slit. It should be noticed that these springy blades are aimed at impeding the involuntary disengagement of the device, but authorize, as the case may be, the voluntary engagement and removal of the device into and from the slit. These fixing means also have wings integral with the lower end of said device and extending towards the transversal edges of the slit. These wings rest on the lower wall of the tubular profile and define the lower edge of the leaf.

One will observe, in this document, that the rolling device is placed and maintained in its position only through the fixing means which only act on the edges of the slit. Thus, the rolling device cannot rest against a metallic reinforcement or a horizontal wall located in the inner portion of the profile.

U.S. Pat. No. 5,161,330 relates to an adjustable rolling device for a sliding leaf of a door or the like.

Such a device is also accomodated in a slit made in the lower edge of a profile defining the lower rail of the leaf. This profile has, in its inner portion, a wall against which is aimed at resting the upper end of the rolling device. This latter is maintained in this position through, on the one hand, a slot provided for at one of its transversal ends for receiving one transversal edge of the slit and, on the other hand, through a springy metal blade. Such a blade is made integral, at its one end, with the device, while its hook-shaped free end co-operates, after putting under strain of the blade, with the other transversal edge of the slit. It should be observed that the height of the device must, in this case, be strictly adjusted to the depth of the slit.

SUMMARY OF THE INVENTION

Finally, this invention is aimed at coping with all the drawbacks arising at the level of the securing of a rolling device under the lower rail of a sliding leaf.

To this end, the invention relates to a rolling device for a sliding leaf of a door, window or the like, comprising a slide receiving rolling means and aimed at being accomodated in a slit provided for in the lower edge of a profile defining the lower rail of said leaf which the slide is made integral with through fixing means comprised, at each transversal end of the slide, of hooking-in means capable of hooking in on the transversal edges of the slit in order to impede the disengagement of said slide, this latter being capable of resting against a metallic reinforcement or a horizontal wall located in the inner portion of said profile, characterized in that:

said hooking-in means are defined by a horizontal rim protruding along the longitudinal axis of the slide, this at the level of its transversal ends, at least one horizontal rim being subjected to springy restoring means acting at least in the longitudinal direction of the slide and allowing to withdraw said hooking-in means in order to allow the passing through, by snapping in, of same, and its removal, said hooking-in means are completed by retaining means capable of a vertically immobilizing said rolling device in the slit of the profile.

The advantages resulting from this invention mainly consist in that, on the one hand, the fitting of the rolling device under the profile defining the lower rail of the leaf can occur by a mere snapping in and one is therefore relieved from any tedious screwing operation. As a matter of fact, the removal is also facilitated, since it is enough to lift the leaf by the height of the rolling device to be able to remove same, without any tool.

Furthermore, irrespective of the material the profile aimed at receiving such a rolling device is made of, it is no longer necessary to machine, as the case may be, the profile or the reinforcement accomodated in this latter for the reception of fixing organs. Though this is advantageous in itself, it should in particular be noticed that this in addition results into the fact that the slit may be made to broader tolerances. The springy restoring means which the hooking-in means at least one end of the slide is provided with are subjected to are indeed capable of compensating for the dimensional changes of this slit, without any constraint.

The invention will be better understood when reading the following description with reference to the attached drawing showing only one embodiment.

DESCRIPTION OF THE PREFERRED EMBODIMENTS

Figure 2:
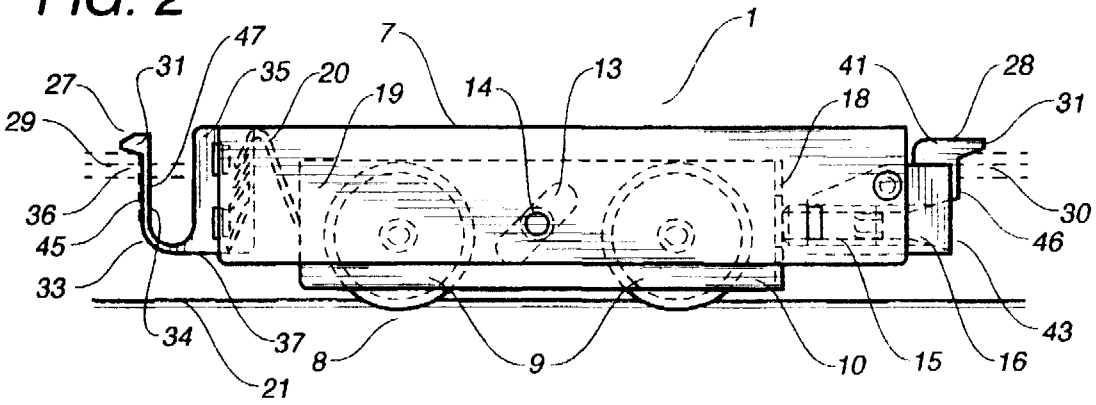
FIG. 2 is an elevational view of the rolling device according to the invention.
Figure 3:
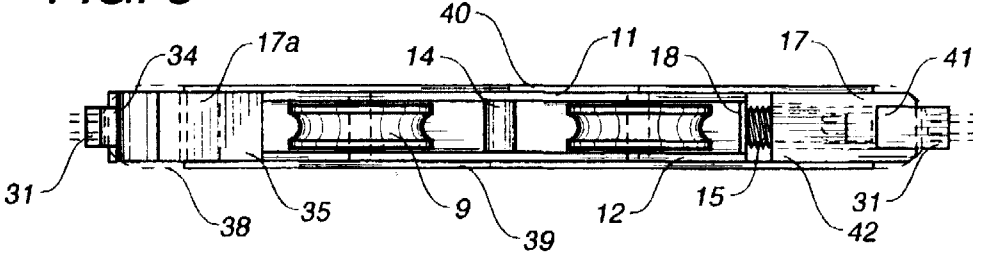
FIG. 3 is a plan view of this rolling device as shown in FIG. 1.
Figure 1:
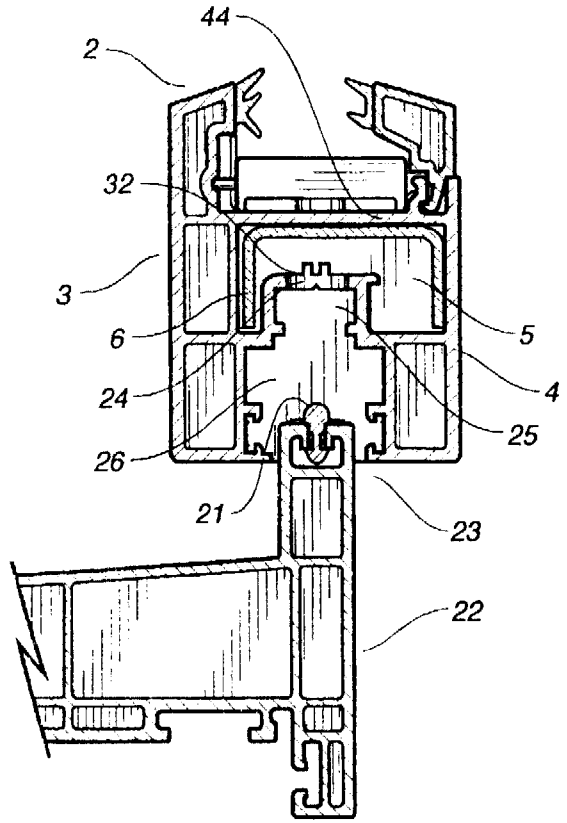
FIG. 1 is a schematical and cross-sectional view of a profile defining the lower rail of a leaf of a door, window or the like, into the groove provided for in the lower edge of this profile being aimed at being inserted the rolling device shown in FIGS. 2 and 3 which rests on a rail which is also cross-sectionally shown in this FIG. 1.

This invention relates to a rolling device 1 as shown in FIGS. 2 and 3, in particular for a sliding leaf 2 of a door, window or the like. In FIG. 1, this leaf 2 has simply been shown in the shape of a profile 4 which, as can be seen, may be made of synthetical material, viz. of PVC, and including, in its inner portion 5, a metallic reinforcement 6. Of course, this invention is in no way limited to such an application of the rolling device 1 to a profile made of synthetical material. This profile 4 may indeed also be a metallic one, in particular made of aluminium alloy.

Turning back to the rolling device 1, this latter is mainly defined by a longitudinally shaped slide 7 with a substantially parallelepipedic cross-section. This slide 7 receives rolling means 8 in the shape of one or several railwheels 9.

For reasons of height adjustment of the leaf, this or these railwheels 9 may, in turn, be rotatingly mounted in a casing 10 including, at the level of its side walls 11, 12, oblique slots 13 through which passes a spindle 14 transversally arranged inside the slide 7. Thus, by ensuring the movement of the casing 10 inside the slide 7 in a longitudinal direction, there is achieved, under the action of the co-operation between the oblique slots 13 and the spindle 14, a movement with a vertical component of this casing 10 with respect to said slide 7.

The adjustment is in particular achieved under the impulsion of a setting screw 15 inserted into a tapped hole 16 provided for at the level of one transversal end 17 of the slide 7, this setting screw 15 resting, at its free end, on the transversal wall 18 of the casing 10. At the opposite end 19 of this latter rest springy restoring means 20 which systematically push back the casing 10 against the setting screw.

There should be observed, in this respect, that such springy restoring means 20 facilitate the removal of the leaf 2 and the disengagement of the railwheels 9 from the guiding rail 21 which, as shown in FIG. 1, is fitted onto the threshold 22 of the door, window or the like. Without these springy restoring means 20, at the time of lifting the leaf 2, said casing would indeed automatically fall downwards, so that the railwheels would remain inserted on the guiding rail 21. Under such circumstances, the leaf 2 would have to be lifted further, which is of course undesirable.

As a matter of fact, as set forth in the introductory part above, this invention is aimed at solving the problem of the fixing of this rolling device 1 at the level of the lower rail 3 of the leaf 2 defined by the profile 4. In this respect, this latter includes, at the level of its lower edge cross-section fitted for the passing through of the rolling device 1. Finally, as can be seen in FIG. 1, this slit 24 is made in the bottom 25 of a U-shaped groove 26 which is usually to be found at the level of this lower edge 23 of such profiles 4. Finally, through this slit 24, the rolling device 1 may rest, 20 within the framework of a profile made of PVC, on the metallic reinforcement 6.

As far as the very fixing of this rolling device is concerned, this is ensured, according to the invention, through hooking-in means 27, 28 the transversal ends 17 and 17A of the slide 7 are provided with, these hooking in means 27, 28 being aimed at co-operating with the transversal edges 29, 30 of the slit 24 provided for in the profile 4.

According to a preferred embodiment, such hooking-in means 27, 28 are defined by a horizontal rim 31 which is protruding along the longitudinal axis of the slide 7, this at the level of its transversal ends 17, 17A. These horizontal rims 31 are therefore aimed at hooking in on the transversal edges 29,30 of the slit 24 and at resting on the inner side 32 of the wall in which this slit 24 is provided for, in this case the bottom 25 of the groove 26 present at the level of the lower edge 23 of the profile 4.

In addition, according to the invention, at least the hooking-in means 27 located at one transversal end 17A of the slide 7 are subjected to springy re-storing means 33 acting at least in the longitudinal direction of this latter and allowing to withdraw these hooking-in means 27 in order to authorize, as the case may be, the fitting by snapping-in of the slide 7 into the slit 24 or its removal.

Such springy restoring means 33 may have various embodiments. Viz., according to one solution not shown in the figures, it may be contemplated to design these springy restoring means 33 in the shape of a helical spring longitudinally arranged inside the slide 7 and acting on a shoe slidingly mounted inside this latter. This shoe is then provided, in its protruding portion at the transversal end 17A of the slide 7 with hooking-in means 27 in the shape of a horizontal rim 31. Thus, by pushing said shoe, and thus the horizontal rim 31, back inside the slide 7, against the action of the spring, the withdrawal of this horizontal rim 31 when passing at the transversal edge 29 of the slit 24 can be ensured.

However, according to a preferred embodiment, these springy restoring means 33, as shown in FIGS. 2 and 3 of the attached drawing, are in the shape of a metal blade 34, made integral, through an appriopriate support 35, with this transversal end 7A of the slide 7, the free end 36 of which is provided with the horizontal rim 31 defining the hooking-in means 27. As a matter of fact, this springy blade 34 is so arranged that it authorizes a movement, along the longitudinal axis of the slide 7, of the horizontal rim 31.

Thus, when it has been shown in a vertical configuration in FIG. 2, this is because the slide 7 has here been fitted into the slit 24. Actually, in resting position, i.e. when dismantled, this springy blade 34 will preferably extend, from the lower portion 37 of the slide 7, where it is made integral with its support 35, inclined whilst substantially diverging from this slide 7. Thus, to ensure the mounting, this springy blade 37 has to be pushed back towards the transversal end 17A of the slide 7, in order to authorize the horizontal rim 31 to pass in front of the transversal edge 29 of the slit 24. When releasing said springy blade 34 after fitment of the whole, said horizontal rim 31 may fully perform its hooking-in function.

It should be noticed that the springy blade 34 is preferably made of synthetic material, from which actually results its elasticity. In addition, it is advantageously moulded together with the horizontal rim 31 and its support 35 substantially forming the transversal wall 38 of the slide 7. With this support 35 are thus made integral, e.g. by crimping, the longitudinal edges 39, 40 of said slide 7.

As regards the hooking-in means 28 at the opposite transversal end 17 of this slide 7, which, they too, are defined by a horizontal rim 31, these in addition include a shoe 41 integral with a casing 42 arranged between the longitudinal walls 39, 40 whilst forming a crosspiece. Thus, this casing 42, which in some way defines the transversal wall of this slide 7 at the level of its transversal end 17, includes the tapped hole 16 in which is inserted the setting screw 15 aimed at acting on the rolling means 8. There should be noticed, in this respect, that the mouth 43 of this hole 16 is truncatedly shaped, thus facilitating the introduction of a tool, such as a screwdriver or a hollow spanner for hexagonal screws, aimed at acting on said setting screw 15.

As a matter of fact, the whole of horizontal rim 31, shoe 41 and casing 42 forms one single moulded part made of synthetic material.

In view of the preceding description and with reference to FIGS. 2 and 3 of the attached drawing, one will notice that when having the leaf 2 rest on the guiding rail 21, the rolling device 1 inserted in the slit 24 will raise inside the profile 4 until it rests on the metallic reinforcement 6 or, in the absence of this latter, on another horizontal wall 44 of this profile 4. Though this does not give rise to any problem on itself, when removing the leaf 2, the rolling device 1 should however be impeded from freely lowering until these hooking-in means 27, 28 rest again on the transversal edges 29, 30 of the slit 24. For this purpose, the hooking-in means 27, 28 are completed by retaining means 47 capable of vertically immobilizing said rolling device 1 in the slit 24 of the profile 4. These retaining means 47 are advantageously associated with the springy blade 34 as well as with the shoe 41. In particular, such retaining means 47 are in the shape of ribs forming a step or of a material with a high friction coefficient, e.g. a pad made of elastomer the side 45, 46 corresponding to this springy blade 34 and this shoe 41, respectively, is provided with, aimed at resting against the transversal edges of the slit 24, this actually in order to vertically immobilize this rolling device in this slit 24 of the profile 4.

Finally, one observes that this invention advantageously solves all the constraints met so far for fixing a rolling device at the level of a profile forming the lower rail of a sliding leaf.

What is claimed:

1. A rolling device for a sliding leaf of a door or a window comprising a lower rail defined by a profile having a lower edge in which is provided a slit including transversal edges, the rolling device further comprises a slide receiving rolling means accommodated in the slit provided in the lower edge of the profile, said slide including transversal ends provided with hooking-in means for hooking in on the transversal edges of the slit in order to impede a disengagement of said slide, the profile including an inner portion where is located a horizontal wall against which the slide is capable of resting, said hooking-in means being defined by a horizontal rim protruding at a level of the transversal ends of the slide including a longitudinal direction, at least one horizontal rim being subjected to springy restoring means acting at least in a longitudinal direction of the slide and allowing to withdraw said hooking-in means in order to allow passing through and snapping in of said slide and a removal of said slide, said hooking-in means having retaining means for vertically immobilizing said rolling device in the slit of the profile.

2. The rolling device according to claim 1, the springy restoring means having a shape of a springy blade made integral, through a support, with the transversal end of the slide, this springy blade including a free end provided with the horizontal rim defining the hooking-in means this springy blade being thus so arranged as to allow a movement of this horizontal rim in the longitudinal direction of the slide.

3. The rolling device according to claim 2, the slide of which includes a lower portion where the springy blade extending, in dismantled position of the rolling device, inclined and substantially diverging from the slide is made integral with its support.

4. The rolling device according to claim 2, the springy blade of which is made of synthetic material and moulded together with the horizontal rim and the support.

5. The rolling device according to claim 2, the slide of which includes a transversal wall substantially formed by the support, said slide including longitudinal walls which said support is made integral with.

6. The rolling device according to claim 1, the hooking-in means of which, at an opposite transversal end of the slide defined by a horizontal rim, include a shoe integral with a casing, the slide including longitudinal walls between which said shoe is arranged while forming a crosspiece.

7. The rolling device according to claim 6, the horizontal rim, the shoe and the casing being formed as one single moulded part of synthetical material.

8. The rolling device according to claim 1, the hooking-in means of which are defined by a horizontal rim with which is provided a springy blade made integral, through an appropriate support with the transversal end of the slide and the hooking-in means of which, at an opposite transversal end of this slide, are defined by a horizontal rim associated with a shoe integral with a casing, the slide including longitudinal walls with which is made integral the support substantially forming a transversal wall of said slide, between these longitudinal walls being arranged the casing while forming a crosspiece, the springy blade and the shoe including a side, applied against the transversal edges of the slit said sides of the springy blade and the shoe including retaining means for vertically immobilizing the rolling device in this slit of the profile.

* * * * *